US008915223B2

(12) United States Patent
Homma et al.

(10) Patent No.: US 8,915,223 B2
(45) Date of Patent: Dec. 23, 2014

(54) VALVE TIMING CONTROL APPARATUS

(75) Inventors: Atsushi Homma, Kariya (JP); Kazunari Adachi, Chiryu (JP); Yuji Noguchi, Obu (JP); Satoshi Nishizawa, Okaya (JP)

(73) Assignees: Aisin Seiki Kabushiki Kaisha, Kariya-Shi, Aichi (JP); Yamani Spring Co., Ltd., Okaya-Shi, Nagano (JP)

( * ) Notice: Subject to any disclaimer, the term of this patent is extended or adjusted under 35 U.S.C. 154(b) by 0 days.

(21) Appl. No.: 13/880,913

(22) PCT Filed: Oct. 14, 2011

(86) PCT No.: PCT/JP2011/073685
§ 371 (c)(1),
(2), (4) Date: Apr. 22, 2013

(87) PCT Pub. No.: WO2012/053447
PCT Pub. Date: Apr. 26, 2012

(65) Prior Publication Data

US 2013/0213327 A1 Aug. 22, 2013

(30) Foreign Application Priority Data

Oct. 22, 2010 (JP) ..... 2010-237784

(51) Int. Cl.
*F01L 1/34* (2006.01)
*F01L 1/344* (2006.01)
*F01L 1/047* (2006.01)

(52) U.S. Cl.
CPC ..... *F01L 1/34* (2013.01); *F01L 2001/0476* (2013.01); *F01L 2250/02* (2013.01); *F01L 1/3442* (2013.01); *F01L 2001/34423* (2013.01); *F01L 2001/34483* (2013.01); *F01L 2001/34479* (2013.01); *F01L 2001/34469* (2013.01)
USPC ..... 123/90.17

(58) Field of Classification Search
USPC ..... 123/90.15, 90.17
See application file for complete search history.

(56) References Cited

U.S. PATENT DOCUMENTS 5,794,577 A 8/1998 Kira
6,032,626 A 3/2000 Haag
(Continued)

FOREIGN PATENT DOCUMENTS

DE 10 2008 000 757 A1 9/2009
JP 10-030410 A 2/1998
(Continued)

OTHER PUBLICATIONS

International Search Report (PCT/ISA/210) issued on Jan. 17, 2012, by the Japanese Patent Office as the International Searching Authority for International Application No. PCT/JP2011/073685.
(Continued)

*Primary Examiner* — Thomas Denion
*Assistant Examiner* — Daniel Bernstein
(74) *Attorney, Agent, or Firm* — Buchanan Ingersoll & Rooney P.C.

(57) ABSTRACT

Provided is a valve timing control apparatus that allows relaxation of manufacturing precision of a driving-side rotary member and a driven-side rotary member and that achieves space saving at the same time. An urging member includes at least one trough-folded portion and at least one crest-folded portion, one end side contact portion formed between one terminal end of the urging member and the trough-folded portion and coming into contact with a sealing element, and other end side contact portion formed between the other terminal end of the urging member and the crest-folded portion and coming into contact with a partitioning portion. In association with urging of the urging member, the distance between the one end side contact portion and the other end side contact portion along the urging direction is decreased and the angles of the trough-folded portion and the crest-folded portion are decreased.

5 Claims, 4 Drawing Sheets

(56) References Cited

U.S. PATENT DOCUMENTS

| | | | | |
|---|---|---|---|---|
| 6,374,785 | B1 | 4/2002 | Schafer et al. | |
| 6,427,654 | B2 * | 8/2002 | Golbach et al. | 123/90.17 |
| 2001/0017117 | A1 | 8/2001 | Golbach et al. | |
| 2007/0113811 | A1 * | 5/2007 | Grunow et al. | 123/90.17 |
| 2009/0044770 | A1 | 2/2009 | Scott et al. | |

FOREIGN PATENT DOCUMENTS

| | | | |
|---|---|---|---|
| JP | 2000-213309 | A | 8/2000 |
| JP | 2001-234713 | A | 8/2001 |
| JP | 2007-092100 | A | 4/2007 |
| JP | 2008-500504 | A | 1/2008 |
| JP | 2009-036345 | A | 2/2009 |
| WO | 2009/115155 | A1 | 9/2009 |

OTHER PUBLICATIONS

Written Opinion (PCT/ISA/237) issued on Jan. 17, 2012, by the Japanese Patent Office as the International Searching Authority for International Application No. PCT/JP2011/073685.

International Preliminary Report on Patentability (PCT/IB/338) and English Translation of Written Opinion of the International Searching Authority (PCT/ISA/237) in the corresponding International Patent Application No. PCT/JP2011/073685.

Supplementary European Search Report dated Oct. 28, 2013 issued in the corresponding European Patent Application No. 11834287.2-1603/2631439.

* cited by examiner

VALVE TIMING CONTROL APPARATUS

TECHNICAL FIELD

The present invention relates to a valve timing control apparatus for adjusting opening/closing timings of an intake valve and an exhaust valve of an internal combustion engine of e.g. an automobile in accordance with a driving condition.

BACKGROUND ART

With this type of valve timing control apparatus, in order to prevent leakage of work fluid between an advance angle chamber and a retard angle chamber, an urging member is disposed at a position of the partitioning portion that faces the driving-side rotary member or the driven-side rotary member or at a position of the driving-side rotary member or the driven-side rotary member that faces the partitioning portion. In this, according to the convention, the valve timing control apparatus would be formed compact for the sake of saving the space for the urging member.

Conventionally, as an urging member that allows space saving, PTL 1 discloses an arrangement wherein the partitioning portion is comprised of a vane disposed in a vane groove of the driven-side rotary member and the urging member is comprised of an arch-shaped plate spring, with an intermediate portion of the urging member being placed in contact with the driven-side rotary member, the opposed end portions of the urging member being placed in contact with the vane.

Further, PTL 2 discloses an arrangement wherein the partitioning portion is comprised of a projecting portion projecting from the driving-side rotary member and the driven-side rotary member and the urging member is comprised of an arch-shaped plate spring, with an intermediate portion of the urging member being placed in contact with the partitioning portion, the opposed end portions of the urging member being placed in contact with a sealing element.

CITATION LIST

Patent Literature

PTL 1: Japanese Unexamined Patent Application Publication No. 10-30410

PTL 2: Japanese Unexamined Patent Application Publication No. 2000-213309

SUMMARY OF INVENTION

Technical Problem

If the urging force of the urging member is too small, leakage of engine oil occurs between the advance angle chamber and the retard angle chamber. On the other hand, if the urging force of the urging member is too large, friction force between the driving-side rotary member and the vane or the sealing element becomes too large, thereby to hinder smooth movement of the driven-side rotary member, which may result in turn in failure to open/close the intake valve at an appropriate timing, or in easy frictional wear/damage of the vane or the sealing element. Therefore, it is desired to confine the urging force of the urging member within an appropriate range.

However, with PTL 1, since it is possible to obtain only the amplitude of oscillation of the arch-shaped plate spring. Hence, the stroke of the urging member becomes short.

Therefore, if there exists a size error in the driving-side rotary member and/or the driven-side rotary member for instance, in association with movement of the driven-side rotary member, there occurs a change in the distance between the vane and the driven-side rotary member or between the projecting portion and the driving-side rotary member or the driven-side rotary member, which results in a change in the dimension of the urging member along the radial direction. In this, as described above, since the stroke of the urging member is short, even a small change in the radial dimension of the urging member may bring about a significant change in the urging force of the urging member. Therefore, in order to confine the urging force of the urging member within an appropriate range, a high manufacturing precision would be required for the driving-side rotary member and the driven-side rotary member.

The object of the present invention is to provide a valve timing control apparatus that achieves space saving and that allows relaxation of manufacturing precision of a driving-side rotary member and a driven-side rotary member.

Solution to Problem

According to a first characterizing feature of a valve timing control apparatus relating to the present invention, a valve timing control apparatus comprises:

a driving-side rotary member rotated in synchronism with a crank shaft;

a driven-side rotary member disposed coaxial with the driving-side rotary member and rotated in synchronism with a valve opening/closing cam shaft of an internal combustion engine;

a partitioning portion provided in at least one of the driving-side rotary member and the driven-side rotary member for partitioning a fluid pressure chamber formed by the driving-side rotary member and the driven-side rotary member into a retard angle chamber and an advance angle chamber;

a sealing element disposed at a position of the partitioning portion that faces the driving-side rotary member or the driven-side rotary member or at a position of the driving-side rotary member or the driven-side rotary member that faces the partitioning portion, the sealing element preventing leakage of work fluid between the retard angle chamber and the advance angle chamber in association with relative rotation between the driving-side rotary member and the driven-side rotary member; and an urging member that provides an urging force due to elastic deformation thereof for urging the sealing element from the side of the partitioning portion to the side of the driving-side rotary member or the driven-side rotary member or urging the sealing element from the side of the driving-side rotary member or the driven-side rotary member to the side of the partitioning portion;

wherein the urging member includes:

at least one trough-folded portion;

at least one crest-folded portion;

one end side contact portion formed between one terminal end of the urging member and the trough-folded portion or the crest-folded portion which portion is disposed on the side of this one terminal end, the one end side contact portion coming into contact with the sealing element; and other end side contact portion formed between the other terminal end of the urging member and the trough-folded portion or the crest-folded portion which portion is disposed on the side of this other terminal end, the other end side contact portion coming into contact with the partitioning portion or the driving-side rotary member or the driven-side rotary member;

wherein in association with urging of the urging member, the distance between the one end side contact portion and the other end side contact portion along the urging direction is decreased and the angles of the trough-folded portion and the crest-folded portion are decreased.

With the above-described arrangement, between the one end side contact portion and the other end side contact portion, at least one trough-folded portion and at least one crest-folded portion are present, and in association with urging of the urging member, the distance between the one end side contact portion and the other end side contact portion along the urging direction is decreased and the angles of the trough-folded portion and the crest-folded portion are decreased. As a result, it is possible to ensure a sufficient long stroke of the urging member. For this reason, even if there occurs a change in the distance between the partitioning portion and the driving-side rotary member or the driven-side rotary member and a change in the radial dimension of the urging member in association with a movement of the driven-side rotary member due to size irregularity in the driving-side rotary member and the driven-side rotary member for instance, the changes do not result in any significant change in the urging force. Consequently, even if the manufacturing precision of the driving-side rotary member and the driven-side rotary member is not increased so much, it is still readily possible to confine the urging force of the urging member within an appropriate range, so that the sealing element can be urged with an appropriate urging force.

According to a second characterizing feature of the present invention, the urging member further includes a non-contact portion between the one end side contact portion and the other end side contact portion; and the one end side contact portion and the other end side contact portion are respectively shorter than the non-contact portion in the longitudinal direction of the urging member.

With the above-described arrangement, even when a large force is applied to the sealing element, this does not lead to contacting of the crest-folded portion or the trough-folded portion with the one end side contact portion or the other end side contact portion. So that, it becomes unnecessary to secure a significant distance between the sealing element and the partitioning member or the driving-side rotary member or the driven-side rotary member. Hence, further space reduction for the urging member becomes possible.

According to a third characterizing feature of the present invention, a valve timing control apparatus comprises:

a driving-side rotary member rotated in synchronism with a crank shaft;

a driven-side rotary member disposed coaxial with the driving-side rotary member and rotated in synchronism with a valve opening/closing cam shaft of an internal combustion engine;

a partitioning portion provided in at least one of the driving-side rotary member and the driven-side rotary member for partitioning a fluid pressure chamber formed by the driving-side rotary member and the driven-side rotary member into a retard angle chamber and an advance angle chamber;

a sealing element disposed at a position of the partitioning portion that faces the driving-side rotary member or the driven-side rotary member or at a position of the driving-side rotary member or the driven-side rotary member that faces the partitioning portion, the sealing element preventing leakage of work fluid between the retard angle chamber and the advance angle chamber in association with relative rotation between the driving-side rotary member and the driven-side rotary member; and an urging member that provides an urging force due to elastic deformation thereof for urging the sealing element from the side of the partitioning portion to the side of the driving-side rotary member or the driven-side rotary member or urging the sealing element from the side of the driving-side rotary member or the driven-side rotary member to the side of the partitioning portion;

wherein the urging member includes:

at least one trough-folded portion;

at least one crest-folded portion;

opposed terminal end contact portions formed respectively between one terminal end of the urging member and the trough-folded portion or the crest-folded portion disposed on the side of this one terminal end and between the other terminal end of the urging member and the trough-folded portion or the crest-folded portion disposed on the side of this other terminal end, the opposed terminal end contact portions coming into contact with the sealing element or one of the partitioning portion, the driving-side rotary member and the driven-side rotary member; and an intermediate contact portion formed between the trough-folded portion or the crest-folded portion disposed on the side of the one terminal end and the trough-folded portion or the crest-folded portion disposed on the side of the other terminal end, the intermediate contact portion coming into contact with the sealing element or one of the partitioning portion, the driving-side rotary member and the driven-side rotary member whichever one is disposed on the side opposite the side contacted by the opposed terminal end contact portions; and wherein in association with urging of the urging member, the distance between the opposed terminal end contact portions and the intermediate contact portion along the urging direction is decreased and the angles of the trough-folded portion and the crest-folded portion are decreased.

With the above-described arrangement, between the one end side contact portion and the other end side contact portion, at least one trough-folded portion and at least one crest-folded portion are present, and in association with urging of the urging member, the distance between the one end side contact portion and the other end side contact portion along the urging direction is decreased and the angles of the trough-folded portion and the crest-folded portion are decreased. As a result, it is possible to ensure a sufficient long stroke of the urging member. For this reason, even if there occur a change in the distance between the partitioning portion and the driving-side rotary member or the driven-side rotary member and a change in the radial dimension of the urging member in association with a movement of the driven-side rotary member, for instance, the changes do not result in any significant change in the urging force. Consequently, it is possible to relax the manufacturing precision of the driving-side rotary member and the driven-side rotary member. In addition, since the urging member is supported at three points with the opposed terminal end contact portions and the intermediate contact portion, the posture of the urging member can be stabilized.

According to a fourth characterizing feature of the present invention, the urging member is a plate spring member and constitutes, as the contact portions, contact faces for coming into face contact with the sealing element, or the partitioning member or the driving-side rotary member or the driven-side rotary member.

With the above-described arrangement, since the urging member comes into contact for a predetermined area with the sealing element, or the partitioning member or the driving-side rotary member or the driven-side rotary member, the posture of the urging member can be further stabilized.

DESCRIPTION OF EMBODIMENTS

Next, there will be explained embodiments wherein the valve timing control apparatus relating to the present invention is applied to an intake valve side of an automobile engine E (an example of internal combustion engine).

First Embodiment

[General Construction]

Figure 1:
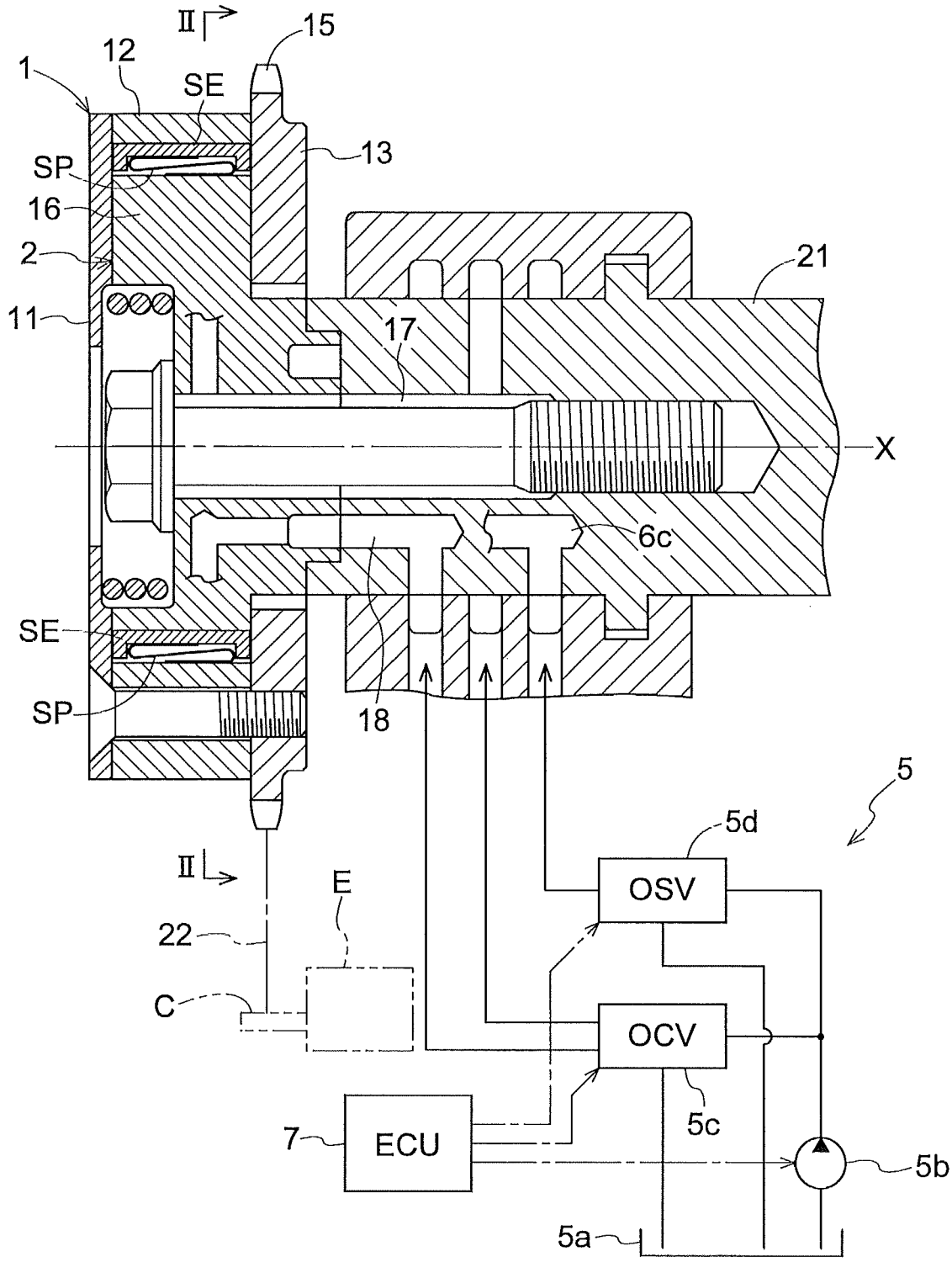
FIG. 1 is a view showing an entire construction of a valve timing control apparatus relating to the present invention.

As shown in FIG. 1, a valve timing control apparatus includes a housing 1 (an example of a "driving-side rotary member") rotatable in synchronism with a crank shaft C and an inner rotor 2 (an example of a "driven-side rotary member") disposed coaxial with the housing 1 and rotatable in synchronism with a cam shaft 21.

(Housing and Inner Rotor)

As shown in FIG. 1, the inner rotor 2 is assembled integral with a leading end portion of the cam shaft 21. The housing 1 includes a front plate 11 disposed on the side opposite the side to which the cam shaft 21 is connected, an outer rotor 12 having a timing sprocket 15, and a rear plate 13 disposed on the side to which the cam shaft 21 is connected.

Figure 2:
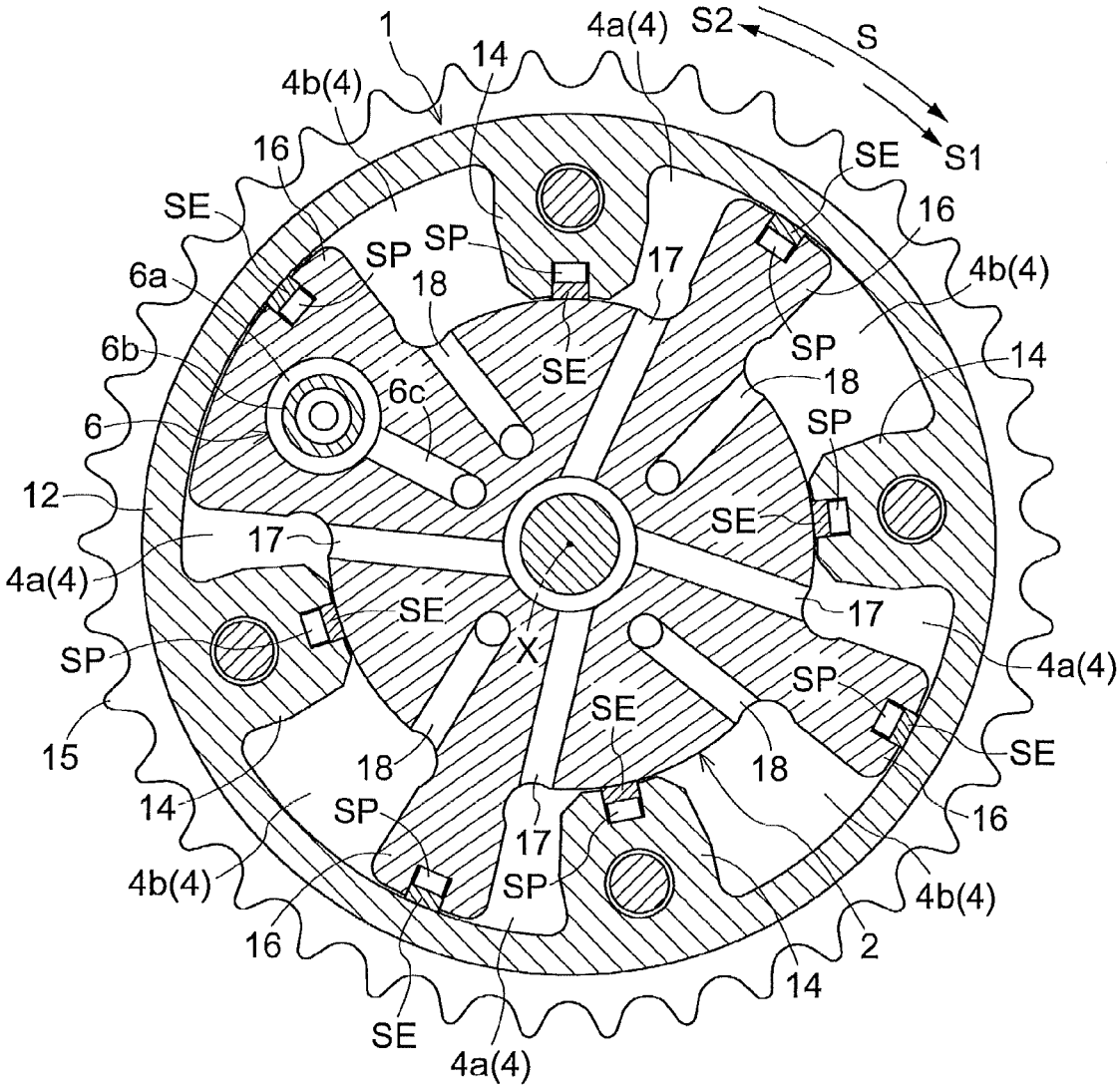
FIG. 2 is a section along II-II in FIG. 1, showing the valve timing control apparatus under a locked state.
Figure 3:
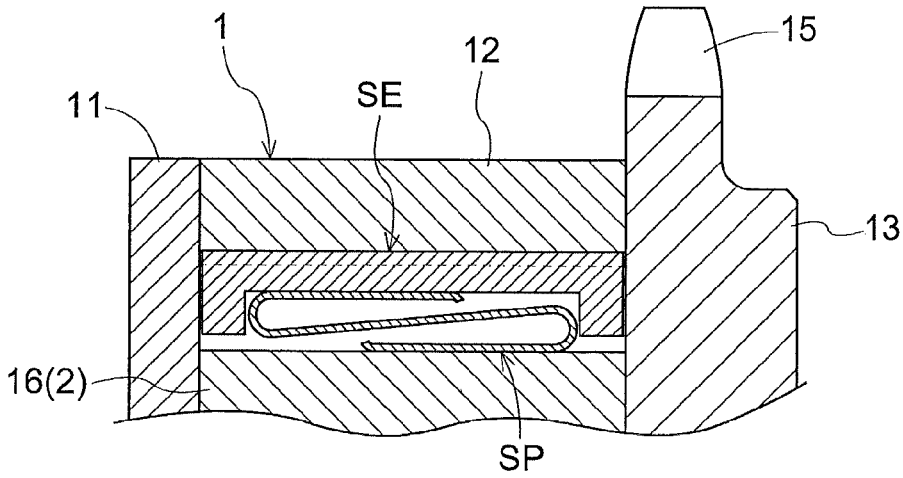
FIG. 3 is an enlarged section view showing periphery of a projecting portion on the side of the outer rotor.
Figure 4:
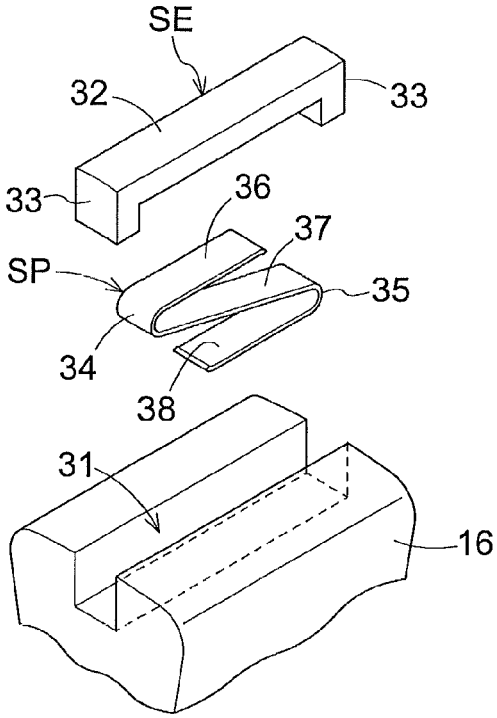
FIG. 4 is an exploded perspective view showing a sealing element and an urging member relating to the present invention.
Figure 5:
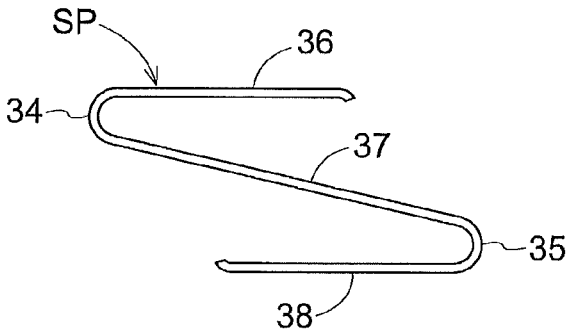
FIG. 5 is a side view showing the urging member.

When the crank shaft C is driven to rotate, its rotational drive force is transmitted via a force transmission member 22 to the timing sprocket 15, whereby the housing 1 is driven to rotate in a rotational direction S (see FIG. 2). In association with this rotational drive of the housing 1, the inner rotor 2 is rotated in the rotational direction S and the cam shaft 21 is rotatably driven. In association with this rotational drive of the cam shaft 21, a cam (not shown) mounted on the cam shaft 21 opens/closes an intake valve (not shown).

As shown in FIG. 2, on and along the inner peripheral face of the outer rotor 12, there are formed a plurality (four in this embodiment) of first projecting portions 14 (an example of "partitioning portion") which project radially inward along the rotational direction S. The first projecting portions 14 extend to the vicinity of the outer peripheral face of the inner rotor 2, so that the space surrounded by the outer rotor 12 and the inner rotor 2 is partitioned by the first projecting portions 14, thus forming a plurality (four in this embodiment) of fluid pressure chambers 4.

On and along the outer peripheral face of the inner rotor 2, there are formed a plurality (four in this embodiment) of second projecting portions 16 (an example of "partitioning portion") projecting radially outwards along the rotational direction S. The second projecting portions 16 extend to the vicinity of the inner peripheral face of the outer rotor 12, so that each fluid pressure chamber 4 is partitioned by the second projecting portion 16 into an advance angle chamber 4*a* and a retard angle chamber 4*b* adjacent along the rotational direction S.

An advance angle passage 17 communicated and connected to each advance angle chamber 4*a* and a retard angle passage 18 communicated and connected to each retard angle chamber 4*b* are formed in the inner rotor 2 and the cam shaft 21.

In operation, engine oil (an example of "work fluid") is fed via the advance angle passage 17 into the advance angle chamber 4*a* and engine oil is discharged via the retard angle passage 18 from the retard angle chamber 4*b*. With this, the hydraulic pressure of the engine oil is applied to the second projecting portion 16 in an angle advancing direction S1 (see FIG. 2) for increasing the capacity of the advance angle chamber 4*a*, whereby the relative rotational phase of the inner rotor 2 relative to the housing 1 is displaced in the angle advancing direction S1. Namely, the cam shaft is angle-advanced relative to the crank shaft C.

Engine oil is fed via the retard angle passage 18 into the retard angle chamber 4*b* and engine oil is discharged via the advance angle passage 17 from the advance angle chamber 4*a*. With this, the hydraulic pressure of the engine oil is applied to the second projecting portion 16 in an angle retarding direction S2 (see FIG. 2) for increasing the capacity of the retard angle chamber 4*b*, whereby the relative rotational phase of the inner rotor 2 relative to the housing 1 is displaced in the angle retarding direction S2. Namely, the cam shaft is angle-retarded relative to the crank shaft C.

Incidentally, the relative rotational phase is maintained at a desired phase by stopping the feeding/discharging of engine oil to/from the advance angle chamber 4*a* and the retard angle chamber 4*b*.

(Locking Mechanism)

As shown in FIG. 2, the valve timing control apparatus is provided with a locking mechanism 6 capable of restricting/locking a relative rotational phase to a locked phase at the time of e.g. startup of the engine E. This locking mechanism 6 includes an accommodating portion 6*a* formed in the second projecting portion 16, a locking member 6*b* accommodated in this accommodating portion 6*a*, a locking groove (not shown) defined in the rear plate 13 and a spring (not shown) for urging the locking member 6*b* in a direction projecting into the locking groove.

This locking mechanism 6 is actuated in response to supply/discharge of engine oil to/from a locking passage 6*c* communicated to the accommodating portion 6*a*.

(Fluid Feeding/Discharging Mechanism)

As shown in FIG. 1 and FIG. 2, the valve timing control apparatus is further provided with a fluid feeding/discharging mechanism 5 for controlling feeding/discharging of the engine oil to/from the advance angle chamber 4*a* and the retard angle chamber 4*b*, and to/from the accommodating portion 6*a*.

This fluid feeding/discharging mechanism 5 includes an oil pan 5*a* for storing an amount of engine oil, an oil pump 5*b* for feeding the engine oil, an oil control valve (OCV) 5*c* for controlling the feeding/discharging of the engine oil to/from the advance angle passage 17 and the retard angle passage 18, and an oil switching valve (OSV) for controlling feeding/ discharging of the engine oil to/from the locking passage 6*c*. These valves, i.e. the oil control valve 5*c* and the oil switching valve 5*d*, are controlled by an ECU 7.

(Sealing Element and Urging Member)

As shown in FIGS. 1-5, if there occurs leakage of the engine oil between the advance angle chamber 4*a* and the retard angle chamber 4*a*, this may result in failure to open/close the intake valve at an appropriate timing. Therefore, in order to prevent such leakage of engine oil, at a leading end portion of the first projecting portion 14 facing the inner rotor 2, a sealing element SE is disposed and there is provided an urging member SP for urging this sealing element SE from the side of the first projecting portion 14 to the side of the inner rotor 2 (radially inward).

Further, at the leading end portion of the second projecting portion 16 facing the outer rotor 12, a sealing element SE is provided and there is provided an urging member SP for urging this sealing element SE from the side of the second projecting portion 16 to the side of the outer rotor 12 (radially outward).

Incidentally, the sealing element SE and the urging member SP provided in the first projecting portion 14 are identical in constructions to the sealing element SE and the urging member SP provided in the second projecting portion 16. Therefore, only the sealing element SE and the urging member SP provided in the second projecting portion 16 will be explained next.

At the leading end portion of the second projecting portion 16, there is formed an attaching groove 31 having a rectangular cross section along the rotational axis X. In this attaching groove 31, the sealing element SE is disposed to be slidable along the radial direction (urging direction) of the inner rotor 2. The sealing element SE includes one sliding contact portion 32 in the form of a rectangular parallelepiped and two leg portions 33 each in the form of a rectangular parallelepiped and projecting from the opposed ends of the sliding contact portion 32 along the direction intersecting this sliding contact portion 32 (the depth direction of the attaching groove 31).

Between the sealing element SE and the attaching groove 31 and between the two leg portions 33, there is mounted the S-shaped urging member SP. This urging member SP is formed by bending one terminal end portion of an elongate plate spring member to form an arcuate one end side folded portion 34 (an example of a "trough-folded portion") and bending the other terminal end portion of the plate spring member to form an arcuate other end side folded portion 35 (an example of a "crest-folded portion").

Between one terminal end of the urging member SP and the one end side folded portion 34, there is formed one end side flat plate portion 36 (an example of a "contacting portion" and a "contact face"). Between one end side folded portion 34 and the other end side folded portion 35, there is formed an intermediate flat plate portion 37 (an example of a "non-contact portion"). Between the other end side folded portion 35 and the other terminal end of the urging member SP, there is formed other end side flat plate portion 38 (an example of a "contacting portion" and a "contact face").

In association with urging of the urging member SP, the radial distance between the one end side flat plate portion 36 and the other end side flat plate portion 38 is decreased and also the angles formed at the one end side folded portion 34 and the other end side folded portion 35 are decreased.

If the urging force of the urging member SP is too small, this may result in leakage of engine oil between the advance change chamber 4*a* and the retard angle chamber 4*b*. On the other hand, if the urging force of the urging member SP is too large, this will result in the frictional force between the inner peripheral face of the outer rotor 12 and the sealing element SE or the frictional force between the outer peripheral face of the inner rotor 2 and the sealing element SE becoming too large, thus possibly hindering smooth movement of the inner rotor 2 or failure to open/close the intake valve at an appropriate timing or leading to readiness of frictional wear/damage of the sealing element SE. Therefore, it is desired that the urging force of the urging member SE be confined within an appropriate range.

According to the present embodiment, between the one end side flat plate portion 36 and the other end side flat plate portion 38, the one end side folded portion 34 and the other end side folded portion 35 are present. Therefore, it is possible to increase the stroke of the urging member SP by an amount corresponding to the number of the folded portions. Then, even if the distance between the inner peripheral face of the outer rotor 12 and the leading end portion of the second projecting portion 16 of the inner rotor 2 or the distance between the outer peripheral face of the inner rotor 2 and the leading end portion of the first projecting portion 14 of the outer rotor 12 is changed and the radial dimension of the urging member SP is changed correspondingly in association with a movement of the inner rotor 2 due to irregularity in the sizes of the outer rotor 12 and the inner rotor 2, such changes do not result in significant change in the urging force. As a result, even if the manufacturing precision of the outer rotor 12 and the inner rotor 2 is not so enhanced, it is readily possible to confine the urging force of the urging member SP within a predetermined range and to urge the sealing element SE with an appropriate urging force.

In addition, since the one end side flat plate portion 36 is placed in gapless contact with the sliding contact portion 32 of the sealing element SE and the other end side flat plate portion 38 is placed in gapless contact with the bottom of the attaching groove 31 of the second projecting portion 16, the posture of the urging member SP can be stabilized.

Incidentally, the stroke of the urging member SP means the difference between the radial dimension of the urging member SP when this urging member SP is maximally compressed and the radial dimension of this urging member SP when the urging member SP is not compressed at all.

In the instant embodiment, the intermediate flat plate portion 37 is formed substantially same as the inner width of the leg portion 33 and the one end side flat plate portion 36 and the other end side flat plate portion 38 respectively are formed shorter than the intermediate flat plate portion 37.

If intermediate flat plate portion 37, the one end side flat plate portion 36 and the other end side flat plate portion 38 were formed substantially same as the inner width of the leg portion 33, when e.g. a significant force is applied to the sealing element SE, the one end side flat plate portion 36 might be inadvertently entrapped between the sliding contact portion 32 of the sealing element SE and the other end side folded portion 35 or the other end side flat plate portion 38 might be inadvertently entrapped between the bottom of the attaching groove 31 of the second projecting portion 16 and the one end side folded portion 34. This would lead to increase in the degree of deformation of the one end side folded portion 34 and the other end side folded portion 35, so that it would become impossible to urge the sealing element SE with an appropriate urging force. Hence, it would be required to secure a large distance between the sealing element SE and the attaching member 31.

On the other hand, according to the above-described inventive arrangement, as the one end side flat plate portion 36 and the other end side flat end portion 38 are formed short, even when a large force is applied to the sealing element SE, such entrapment of the one end side flat plate portion 36 or the other end side flat plate portion 38 would not occur. For this reason, compared with the arrangement in which the intermediate flat plate portion 37, the one end side flat plate portion 36 and the other end side flat plate portion 38 are formed with a same width, it is possible to decrease the distance between the sealing element SE and the attaching groove 31 by an amount corresponding to the thicknesses of the one end side flat plate portion 36 and the other end side flat plate portion 38. As a result, space saving of the urging member SP is made possible.

However, if space saving of the urging member SP is not so needed, then, the intermediate flat plate portion 37, the one end side flat plate portion 36 and the other end side flat plate portion 38 may be formed with a same width. With this, it becomes possible to obtain maximal contact area between the one end side flat plate portion 36 and the sliding contact portion 32 of the sealing element SE and maximal contact area between the other end side flat plate portion 38 and the bottom of the attaching groove 31 of the second projecting portion 16, whereby the posture of the urging member SP can be further stabilized.

In the instant embodiment, at the end of the one end side flat plate portion 36, there is formed one end side folded-back portion folded in the opposite direction to the sliding contact portion 32 of the sealing element SE and at the end of the other end side flat plate portion 38, there is formed the other end side folded-back portion folded in the opposite direction to the bottom of the attaching groove 31 of the second projecting portion 16. With this, the end face of the one end side flat plate portion 36 or the other end side flat plate portion 38 does not contact the sliding contact portion 32 of the sealing element SE or the bottom of the attaching groove 31 of the second projecting portion 16. As a result, it becomes possible to prevent formation of scratch in the sliding contact portion 32 of the sealing element SE or the bottom of the attaching groove 31 of the second projecting portion 16.

Instead of forming one end side folded-back portion at the end of the one end side flat plate portion 36 and forming the other end side folded-back portion at the end of the other end side flat plate portion 38, the ends of the one end side flat plate portion 36 and the other end side flat plate portion 38 may be polished to form rounded portions. With this, it becomes possible to prevent formation of scratch in the sliding contact portion 32 of the sealing element SE or the bottom of the attaching groove 31 of the second projecting portion 16, while securing a long stroke for the urging member SP.

Second Embodiment

In this embodiment, only an arrangement differing from that of the first embodiment will be explained and explanation of the same arrangement will be omitted.

Figure 6:
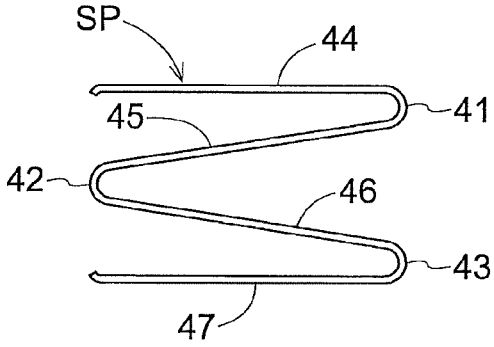
FIG. 6 is a side view showing an urging member relating to a second embodiment.

As shown in FIG. 6, the urging member SP relating to the present invention may be formed to have a letter M-shape.

This urging member SP includes three folded portions 41, 42, 43. In association with the urging of the urging member SP, the radial distance between one end side flat plate portion 44 and the other end side flat plate portion 47 is decreased and also the angles of the three folded portions 41, 42, 43 are decreased. With this, the same function/effect as the first embodiment can be obtained.

In the case of the urging member SP of the first embodiment (see FIG. 5), in association with the urging of the urging member SP, the one end side folded portion 34 and the other end side folded portion 35 are moved along the longitudinal direction (direction intersecting the urging direction) of the urging member SP, and the one end side flat plate portion 36 and the other end side flat plate portion 38 are moved relative to each other. Therefore, the one end side flat plate portion 36 and the other end side flat plate portion 38 effect sliding movements.

However, in the case of the urging member SP of the second embodiment, in association with compression of the urging member SP, even when the two folded portions 41, 42 and the two folded portions 42, 43 are moved respectively relative to each other along the longitudinal direction, the two folded portions 41, 43 are not moved along the longitudinal direction and the one end side flat plate portion 44 and the other end side flat plate portion 47 are not moved relative to each other. Therefore, the one end side flat plate portion 44 and the other end side flat plate portion 47 do not effect any sliding movements. Hence, frictional wear/damage of the sealing element SE and the second projecting portion 16 is less likely to occur.

In this embodiment, the one end side flat plate portion 44, a flat plate portion 45 closer to the one end (an example of "a non-contact portion"), a flat plate portion 46 closer to the other end (an example of "a non-contact portion") and the other end side flat plate portion 47 have a substantially same width as the inner width of the leg portion 33. However, it is alternatively possible to form the flat plate portion 45 closer to the one end and the flat plate portion 46 closer to the other end with a substantially same width as the inner width of the leg portion 33 and to form the one end side flat plate portion 44 and the other end side flat plate portion 47 shorter than the flat plate portion 45 closer to the one end and the flat plate portion 46 closer to the other end.

In this embodiment, the respective folded portions 41, 42, 43 have a same curvature radius. Instead, relative to the intermediate folded portion 42, the other folded portions 41, 43 may have a different curvature radius. With this, it becomes easier to obtain balance between the right and left urging forces of the urging member SP.

In case the curvature radius of the intermediate folded portion 42 is greater than that of the other folded portions 41, 43, the one end side flat plate portion 44 and the other end side flat plate portion 47 may be formed short. With this, even when the size of the intermediate folded portion 42 is increased, this intermediate folded portion 42 will hardly contact the one end side flat plate portion 44 or the other end side flat plate portion 47. Consequently, deformation of the intermediate folded portion 42 can be prevented advantageously.

Third Embodiment

Figure 7:
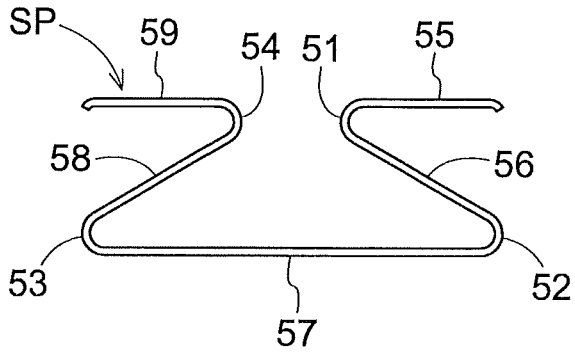
FIG. 7 is a side view showing an urging member relating to a third embodiment.

As shown in FIG. 7, the urging member SP relating to the present invention may have an approximately O-like shape. This urging member SP is identical to an assembly of two of the urging members SP of the first embodiment (see FIG. 5) connected to each other.

Between one terminal end of the urging member SP and one end side folded portion 51, there is formed one end side flat plate portion 55 (an example of a "contacting portion" and a "contact face") which comes into face contact with the sliding contact portion 32 of the sealing element SE. Between the one end side folded portion 51 and a folded portion 52 closer to the one end, there is formed a flat plate portion 56 closer to the one end. Between the folded portion 52 closer to the one end and a folded portion 53 closer to the other end, there is formed an intermediate flat plate portion 57 (an example of a "contacting portion" and a "contact face")

which comes into face contact with the bottom of the attaching groove 31 of the second projecting portion 16. Between the folded portion 53 closer to the other end and the other end side folded portion 54, there is formed a flat plate portion 58 closer to the other side. Between the other end side folded portion 54 and the other terminal end of the urging member SP, there is formed other end side flat plate portion 59 (an example of a "contacting portion" and a "contact face") which comes into face contact with the sliding contact portion 32 of the sealing element SE.

In association with urging of the urging member SP, the distances between the one end side flat plate portion 55 and the other end side flat plate portion 59 and the intermediate flat plate portion 57 are decreased, and also the angles of the respective adjacent folded portions 51, 52, 53, 54 are decreased.

With the above, the same function/effect as the first embodiment can be obtained. In addition, since the urging member SP is supported by the three faces of the one end side flat plate portion 55, the intermediate flat plate portion 57 and the other end side flat plate portion 59, the posture of the urging member SP can be stabilized.

Fourth Embodiment

Figure 8:
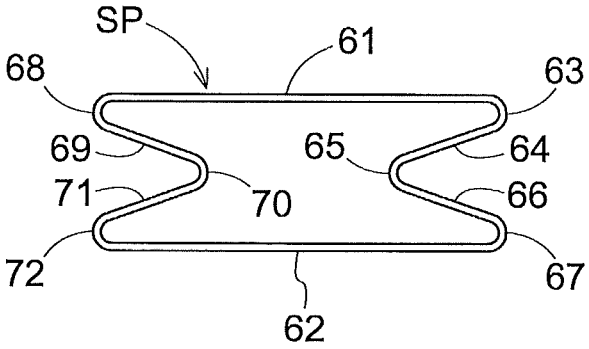
FIG. 8 is a side view showing an urging member relating to a fourth embodiment.

Further alternatively, the urging member SP relating to the present invention may be formed in the continuous shape of a hand-drum as shown in FIG. 8. This urging member SP is identical to an assembly of two of the urging members SP of the second embodiment (see FIG. 6) connected to each other.

This urging member SP includes a first flat plate portion 61 (an example of a "contacting portion" and a "contact face") which comes into face contact with the sliding contact portion 32 of the sealing element SE and a second flat plate portion 62 (an example of a "contacting portion" and a "contact face") which comes into face contact with the bottom of the attaching groove 31 of the second projecting portion 16.

With the above, the same function/effect as the first embodiment can be obtained. In addition, like the urging member SP of the second embodiment, in association with compression of the urging member SP, no relative movement occurs between the first flat plate portion 61 and the second flat plate portion 62. Therefore, frictional wear/damage of the sealing element SE and the second projecting portion 16 becomes less likely to occur. And, when the urging member SP is formed like a loop as described above, due to absence of any end face therein, scratch will be less likely to be formed in the sliding contact portion 32 of the sealing element SE and the bottom of the attaching groove 31 of the second projecting portion 16.

Other Embodiments

In the foregoing embodiments, the second projecting portions 16 are formed in the inner rotor 2. However, the invention is not limited thereto. For instance, though not shown, vane grooves may be formed in the inner rotor 2 and plate-like vanes may be mounted in the vane grooves. In this case, the vanes per se are urged against the outer rotor 12, thus serving as "sealing elements". Therefore, the sealing elements and the urging members relating to the present invention will be provided only in the first projecting portions 14 as partitioning portions on the side of the outer rotor 12.

In the foregoing embodiments, attaching grooves are formed in the first projecting portions 14 of the outer rotor 12 and the second projecting portions 16 of the inner rotor 2 and the sealing elements SE are mounted in these attaching grooves. Instead, attaching grooves may be formed in the inner rotor 2 portions facing the first projecting portions 14 of the outer rotor 12 and the outer rotor 12 portions facing the second projecting portions 16 of the inner rotor 2 and the sealing elements SE may be mounted in these groove portions.

In the foregoing embodiments, the urging members SP are provided as plate springs. However, the invention is not limited thereto. For instance, though not shown, the urging member SP may be comprised of a wire spring member or a member formed by connecting a wire spring member and a plate spring member.

INDUSTRIAL APPLICABILITY

The valve timing control apparatus relating to the present invention is applicable not only to the intake valve side, but also to both the intake valve side and the exhaust valve side.

REFERENCE SIGNS LIST

1 driving-side rotary member
2 driven-side rotary member
4 fluid pressure chamber
4*a* advance angle chamber
4*b* retard angle chamber
14 partitioning portion
16 partitioning portion
35, 41, 43, 52, 53, 65, 70 crest-folded portions
34, 42, 51, 54, 63, 67, 68, 72 trough-folded portions
36, 38, 44, 47, 55, 57, 59, 61, 62 contacting portion, contact face
37, 45, 46 non-contact portions
SE sealing element
SP urging member

The invention claimed is:

1. A valve timing control apparatus comprising:

a driving-side rotary member rotated in synchronism with a crank shaft;

a driven-side rotary member disposed coaxial with the driving-side rotary member and rotated in synchronism with a valve opening/closing cam shaft of an internal combustion engine;

a partitioning portion provided in at least one of the driving-side rotary member and the driven-side rotary member for partitioning a fluid pressure chamber formed by the driving-side rotary member and the driven-side rotary member into a retard angle chamber and an advance angle chamber;

a sealing element disposed at a position of the partitioning portion that faces the driving-side rotary member or the driven-side rotary member or at a position of the driving-side rotary member or the driven-side rotary member that faces the partitioning portion, the sealing element preventing leakage of work fluid between the retard angle chamber and the advance angle chamber in association with relative rotation between the driving-side rotary member and the driven-side rotary member; and an S-shaped urging member that provides an urging force due to elastic deformation thereof for urging the sealing element from the side of the partitioning portion to the side of the driving-side rotary member or the driven-side rotary member or urging the sealing element from the side of the driving-side rotary member or the driven-side rotary member to the side of the partitioning portion;

wherein the urging member includes:

one trough-folded portion;

one crest-folded portion;

one end side contact portion formed between one terminal end of the urging member and the trough-folded portion disposed on the side of this one terminal end, the one end side contact portion coming into surface-contact with the sealing element and not coming into contact with the partitioning portion or the driving-side rotary member or the driven-side rotary member; and other end side contact portion formed between the other terminal end of the urging member and the crest-folded portion disposed on the side of this other terminal end, the other end side contact portion coming into surface-contact with the partitioning portion or the driving-side rotary member or the driven-side rotary member and not coming into contact with the sealing element;

wherein the one end side contact portion and the other end side contact portion partially overlap each other at the center of the urging member in a longitudinal direction thereof, and the remaining portions do not overlap each other, when the urging member is viewed along a radial direction of the driving-side rotary member or the driven-side rotary member;

wherein the one end side contact portion and the crest-folded portion do not overlap each other, and the other end side contact portion and the trough-folded portion do not overlap each other, when the urging member is viewed along the radial direction; and wherein in association with urging of the urging member, the distance between the one end side contact portion and the other end side contact portion along the urging direction is decreased and the angles of the trough-folded portion and the crest-folded portion are decreased during operation of the apparatus.

2. A valve timing control apparatus according to claim 1, wherein the urging member further includes a non-contact portion between the one end side contact portion and the other end side contact portion; and the one end side contact portion and the other end side contact portion are respectively shorter than the non-contact portion in the longitudinal direction of the urging member.

3. A valve timing control apparatus according to claim 1, wherein the urging member is a plate spring member and constitutes, as the contact portions, contact faces for coming into face contact with the sealing element, or the partitioning member or the driving-side rotary member or the driven-side rotary member.

4. A valve timing control apparatus comprising:

a driving-side rotary member rotated in synchronism with a crank shaft;

a driven-side rotary member disposed coaxial with the driving-side rotary member and rotated in synchronism with a valve opening/closing cam shaft of an internal combustion engine;

a partitioning portion provided in at least one of the driving-side rotary member and the driven-side rotary member for partitioning a fluid pressure chamber formed by the driving-side rotary member and the driven-side rotary member into a retard angle chamber and an advance angle chamber;

a sealing element disposed at a position of the partitioning portion that faces the driving-side rotary member or the driven-side rotary member or at a position of the driving-side rotary member or the driven-side rotary member that faces the partitioning portion, the sealing element preventing leakage of work fluid between the retard angle chamber and the advance angle chamber in association with relative rotation between the driving-side rotary member and the driven-side rotary member; and an Ω-shaped urging member that provides an urging force due to elastic deformation thereof for urging the sealing element from the side of the partitioning portion to the side of the driving-side rotary member or the driven-side rotary member or urging the sealing element from the side of the driving-side rotary member or the driven-side rotary member to the side of the partitioning portion;

wherein the urging member includes:

two trough-folded portions;

two crest-folded portions;

opposed terminal end contact portions formed respectively between one terminal end of the urging member and the trough-folded portion disposed on the side of this one terminal end and between the other terminal end of the urging member and the trough-folded portion disposed on the side of this other terminal end, the opposed terminal end contact portions coming into surface-contact with the sealing element or one of the partitioning portion, the driving-side rotary member and the driven-side rotary member; and an intermediate contact portion formed between the crest-folded portion disposed in a position extending from the trough-folded portion disposed on the side of the one terminal end and the crest-folded portion disposed in a position extending from the trough-folded portion disposed on the side of the other terminal end, the intermediate contact portion coming into surface-contact with the sealing element or one of the partitioning portion, the driving-side rotary member and the driven-side rotary member whichever one is disposed on the side opposite the side contacted by the opposed terminal end contact portions and not coming into contact with the sealing element or one of the partitioning portion, the driving-side rotary member and the driven-side rotary member whichever one is disposed on the side contacted by the opposed terminal end contact portions;

wherein the opposed terminal end contact portions and the intermediate contact portion partially overlap each other when the urging member is viewed along a radial direction of the driving-side rotary member or the driven-side rotary member; and wherein in association with urging of the urging member, the distance between the opposed terminal end contact portions and the intermediate contact portion along the urging direction is decreased and the angles of the trough-folded portion and the crest-folded portion are decreased during operation of the apparatus.

5. A valve timing control apparatus comprising:

a driving-side rotary member rotated in synchronism with a crank shaft;

a driven-side rotary member disposed coaxial with the driving-side rotary member and rotated in synchronism with a valve opening/closing cam shaft of an internal combustion engine;

a partitioning portion provided in at least one of the driving-side rotary member and the driven-side rotary member for partitioning a fluid pressure chamber formed by the driving-side rotary member and the driven-side rotary member into a retard angle chamber and an advance angle chamber;

a sealing element disposed at a position of the partitioning portion that faces the driving-side rotary member or the driven-side rotary member or at a position of the driving-side rotary member or the driven-side rotary member that faces the partitioning portion, the sealing element preventing leakage of work fluid between the retard angle chamber and the advance angle chamber in association with relative rotation between the driving-side rotary member and the driven-side rotary member; and an S-shaped urging member that provides an urging force due to elastic deformation thereof for urging the sealing element from the side of the partitioning portion to the side of the driving-side rotary member or the driven-side rotary member or urging the sealing element from the side of the driving-side rotary member or the driven-side rotary member to the side of the partitioning portion;

wherein the urging member includes:

one trough-folded portion;

one crest-folded portion;

one end side contact portion formed between one terminal end of the urging member and the trough-folded portion disposed on the side of this one terminal end, the one end side contact portion coming into surface-contact with the sealing element; and other end side contact portion formed between the other terminal end of the urging member and the crest-folded portion disposed on the side of this other terminal end, the other end side contact portion coming into surface-contact with the partitioning portion or the driving-side rotary member or the driven-side rotary member;

wherein in association with urging of the urging member, the distance between the one end side contact portion and the other end side contact portion along the urging direction is decreased and the angles of the trough-folded portion and the crest-folded portion are decreased during operation of the apparatus;

wherein the entirety of the one end side contact portion and the other end side contact portion is disposed between the trough-folded portion and the crest-folded portion in a fore-and-aft direction of the urging member when the urging member is viewed along a radial direction of the driving-side rotary member or the driven-side rotary member;

wherein the one end side contact portion and the other end side contact portion partially overlap each other at the center of the urging member in a longitudinal direction thereof, and the remaining portions do not overlap each other, when the urging member is viewed along the radial direction; and wherein the one end side contact portion and the crest-folded portion do not overlap each other, and the other end side contact portion and the trough-folded portion do not overlap each other, when the urging member is viewed along the radial direction.

* * * * *